US007091494B2

(12) United States Patent
Weisner et al.

(10) Patent No.: US 7,091,494 B2
(45) Date of Patent: Aug. 15, 2006

(54) RADIOISOTOPE GENERATOR

(75) Inventors: Peter Stewart Weisner, Amersham (GB); Terence Robert Frederick Forrest, Amersham (GB)

(73) Assignee: GE Healthcare Ltd., Buckinghamshire (GB)

( * ) Notice: Subject to any disclaimer, the term of this patent is extended or adjusted under 35 U.S.C. 154(b) by 0 days.

(21) Appl. No.: 10/511,406

(22) PCT Filed: Dec. 11, 2002

(86) PCT No.: PCT/GB02/05613

§ 371 (c)(1),
(2), (4) Date: Oct. 12, 2004

(87) PCT Pub. No.: WO03/088270

PCT Pub. Date: Oct. 23, 2003

(65) Prior Publication Data

US 2005/0116186 A1 Jun. 2, 2005

(30) Foreign Application Priority Data

Apr. 11, 2002 (GB) ..... 0208354.1

(51) Int. Cl.
*G21G 4/08* (2006.01)

(52) U.S. Cl. ..... 250/432 PD

(58) Field of Classification Search ..... None
See application file for complete search history.

(56) References Cited

U.S. PATENT DOCUMENTS 3,369,121 A * 2/1968 Bruno et al. ..... 250/432 R
3,564,256 A 2/1971 Arlman et al.
3,631,654 A * 1/1972 Riely et al. ..... 96/6
3,774,035 A 11/1973 Litt
3,783,291 A * 1/1974 Czaplinski et al. ..... 250/432 R
4,211,588 A 7/1980 Raines
4,387,303 A 6/1983 Benjamins
4,801,047 A 1/1989 Klatte et al.
5,109,160 A 4/1992 Evers

FOREIGN PATENT DOCUMENTS

| | | |
|---|---|---|
| EP | 0256453 | 2/1988 |
| JP | H6-181810 | 7/1994 |
| WO | 9745841 | 12/1997 |

OTHER PUBLICATIONS

International Search Report for PCT/GB02/05613 dated Mar. 5, 2003.
British Search Report of Priority application GB0208354.1 dated Dec. 4, 2002.

* cited by examiner

*Primary Examiner*—Jack I. Berman
(74) *Attorney, Agent, or Firm*—Robert F. Chisholm

(57) ABSTRACT

The invention relates to a device for producing a fluid containing a radioactive constituent, the device comprising: a shielded chamber (5) within which is located an isotope container (6) housing a radioactive isotope (7), the shielded chamber including first and second fluid connections (12,13) to opposing ends of the isotope container and a fluid conduit (14,15) extending from each of the first and second fluid connections to a fluid inlet (16) and a fluid outlet (17) respectively characterised in that the fluid inlet comprises a single spike (22) having a substantially circular cross-section, the spike being adapted to penetrate the rubber seal of a vial and the spike having two bores, the first bore extending from a first aperture adjacent the tip of the spike to a fluid connection with the fluid conduit and the second bore extending from a second, separate aperture in the spike to a filtering air inlet.

5 Claims, 2 Drawing Sheets

RADIOISOTOPE GENERATOR

This application is a filing under 35 U.S.C. 371 of international application number PCT/GB02/05613, filed Dec. 11, 2002, which claims priority to application number 0208354.1 filed Apr. 11, 2002, in Great Britain the entire disclosure of which is hereby incorporated by reference

FIELD OF INVENTION

The present invention relates to a radioisotope generator of the type commonly used to generate radioisotopes such as metastable technetium-99m ($^{99m}$Tc).

BACKGROUND OF THE INVENTION

The diagnosis and/or treatment of disease in nuclear medicine constitute one of the major applications of short-lived radioisotopes. It is estimated that in nuclear medicine over 90% of the diagnostic procedures performed worldwide annually use $^{99m}$Tc labelled radio-pharmaceuticals. Given the short half-life of radio-pharmaceuticals, it is helpful to have the facility to generate suitable radioisotopes on site. Accordingly, the adoption of portable hospital/clinic size $^{99m}$Tc generators has greatly increased over the years. Portable radioisotope generators are used to obtain a shorter-lived daughter radioisotope which is the product of radioactive decay of a longer-lived parent radioisotope, usually adsorbed on a bed in an ion exchange column. Conventionally, the radioisotope generator includes shielding around the ion exchange column containing the parent radioisotope along with means for eluting the daughter radioisotope from the column with an eluate, such as saline solution. In use, the eluate is passed through the ion exchange column and the daughter radioisotope is collected in solution with the eluate, to be used as required.

In the case of $^{99m}$Tc, this radioisotope is the principle product of the radioactive decay of $^{99}$Mo. Within the generator, conventionally the $^{99}$Mo is adsorbed on a bed of aluminium oxide and decays to generate $^{99m}$Tc. As the $^{99m}$Tc has a relatively short half-life it establishes a transient equilibrium within the ion exchange column after approximately twenty-four hours. Accordingly, the $^{99m}$Tc can be eluted daily from the ion exchange column by flushing a solution of chloride ions, i.e. sterile saline solution through the ion exchange column. This prompts an ion exchange reaction, in which the chloride ions displace $^{99m}$Tc but not $^{99}$Mo.

In the case of radio-pharmaceuticals, it is highly desirable for the radioisotope generation process to be performed under aseptic conditions i.e. there should be no ingress of bacteria into the generator. Moreover, due to the fact that the isotope used in the ion exchange column of the generator is radioactive, and is thereby extremely hazardous if not handled in the correct manner, the radioisotope generation process also should be performed under radiologically safe conditions. Therefore, current radioisotope generators are constructed as closed units with fluid inlet and outlet ports providing external fluid connections to the inner ion exchange column.

U.S. Pat. No. 3,564,256 describes a radioisotope generator in which the ion exchange column is in a cylindrical holder which is located within two box-shaped elements that are in turn located within appropriate radiation shielding. The holder is closed by rubber plugs at both ends, and the box-shaped elements have passages opposite each of the rubber plugs in which respective needles are located. At the outermost ends of the needles quick-coupling members are provided to enable a syringe vessel containing a saline solution to be connected to one of the needles and to enable a collection vessel to be connected to the other of the two needles. This document acknowledges that as the two syringes form a closed system there is no need for air to be withdrawn or added.

U.S. Pat. No. 4,387,303 describes a radioisotope generator in which air is introduced to the eluate conduit via a branched pipe so that the hollow spike used to delivery the eluate to be collected has a single bore as the air is introduced into the fluid upstream.

U.S. Pat. No. 4,801,047 describes a dispensing device for a radioisotope generator in which the vial containing the saline solution that will be used to flush out the desired radioisotope from the ion exchange column, is mounted in a carrier that is moveable relative to the hollow needle used to pierce the seal of the vial and to extract the saline solution. The drawings of this document clearly illustrate two separate spaced apart hollow needles one to deliver air and one to collect fluid. The dispensing device is intended to penetrate an elastic stopper and so presents the problem that any rotational movement of the eluant container will result in tearing of the stopper which in turn destroys the aseptic environment through the uncontrolled introduction of air into the system. A similar dual needle system is illustrated in U.S. Pat. No. 5,109,160.

Although piercing devices are known that employ a single spike with two channels such as that illustrated in U.S. Pat. No. 4,211,588 such piercing devices have been restricted in their application in general to intravenous systems.

SUMMARY OF THE INVENTION

The present invention seeks to provide a radioisotope generator that is simple in construction but which ensures the necessary degree of sterility and radiological protection is maintained during use.

In accordance with the present invention, there is provided a device for producing a fluid containing a radioactive constituent, the device comprising: a shielded chamber within which is located an isotope container housing a radioactive isotope, the shielded chamber including first and second fluid connections to opposing ends of the isotope container and a fluid conduit extending from each of the first and second fluid connections to a fluid inlet and a fluid outlet respectively characterised in that the fluid inlet comprises a single spike having a substantially circular cross-section, the spike being adapted to penetrate the rubber seal of a vial and the spike having two bores, the first bore extending from a first aperture adjacent the tip of the spike to a fluid connection with the fluid conduit and the second bore extending from a second, separate aperture in the spike to a filtering air inlet.

Thus, with the present invention rotational movement of a vial penetrated by the spike would not result in tearing of the rubber seal in a manner that would result in the ingress of unfiltered air. Thus, this construction of radioisotope generator ensures that the aseptic conditions of the generator are maintained during use.

BRIEF DESCRIPTION OF THE DRAWING

An embodiment of the present invention will now be described, by way of example only, with reference to the accompanying drawings, in which.

DETAILED DESCRIPTION OF THE PREFERRED EMBODIMENTS OF THE INVENTION

Figure 1:
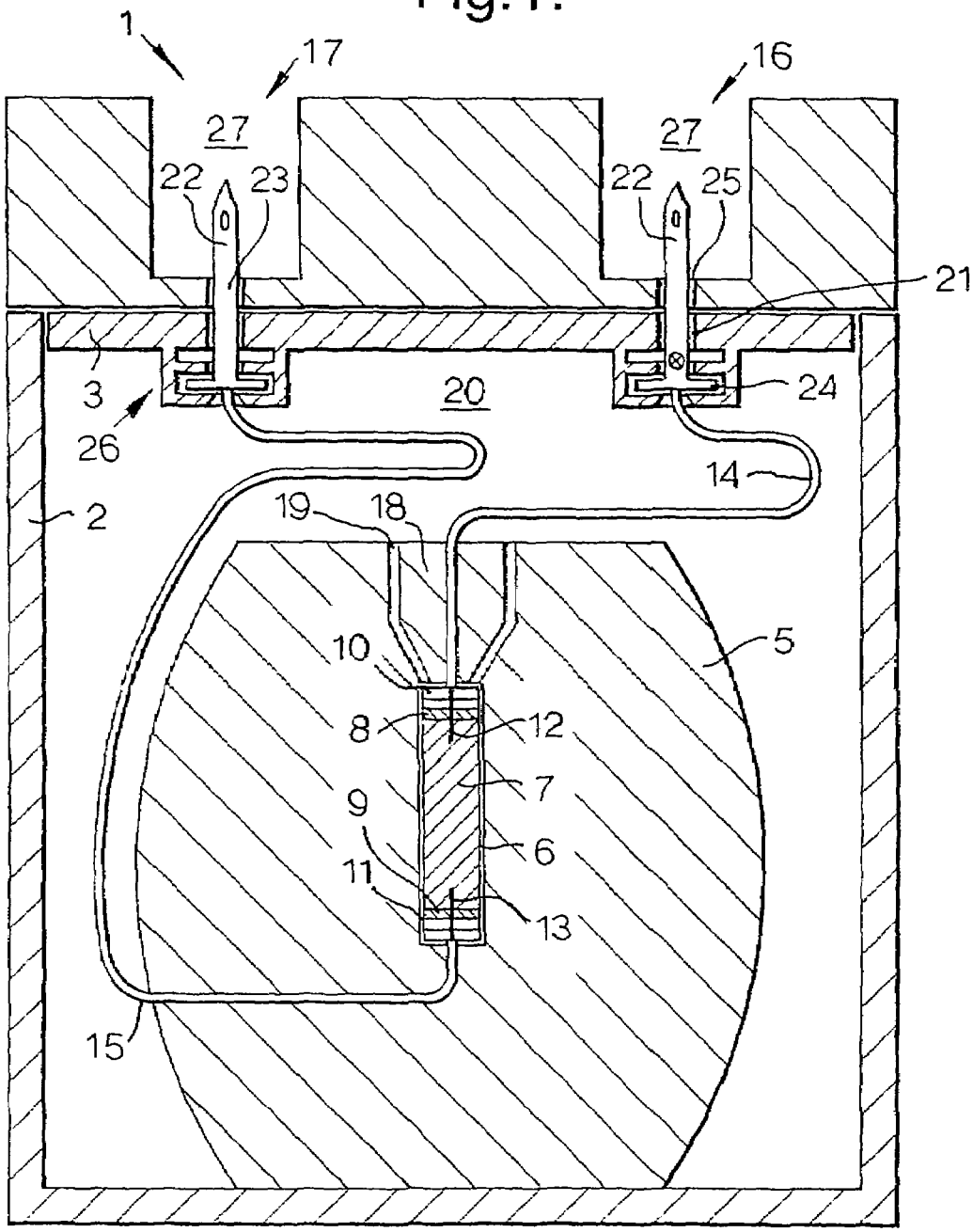
FIG. 1 illustrates a radioisotope generator having fluid connections to the ion exchange column in accordance with the present invention.

FIG. 1 illustrates a radioisotope generator 1 comprising an outer container 2, a top plate 3 which is sealingly secured to the outer container 2, and a separate top cover 4 which is secured to the outer container 2 over the top plate 3. Inside the outer container 2 an inner shielded container 5, providing shielding against radiation, is located which is preferably, but not exclusively, made from either lead or a depleted uranium core within a stainless steel shell. The shielded container 5 surrounds a tube 6 containing an ion exchange column 7. The ion exchange column 7 preferably consists of a mixture of aluminium and silica, onto which molybdenum in the form of its radioactive isotope, $^{99}$Mo is adsorbed. The tube 6 containing the ion exchange column has frangible rubber seals 8 and 9 at opposing ends 10 and 11 which, as illustrated, when in use are pierced by respective hollow needles 12 and 13.

Each of the hollow needles 12 and 13 is in fluid communication with a respective fluid conduit 14, 15 that are in turn in fluid communication respectively with an eluent inlet 16 and an eluate outlet 17. The fluid conduits 14, 15 are preferably flexible plastics tubing. The tubing 14, extending from the hollow needle 12, passes through a channel in a container plug 18, that closes the upper opening 19 to the shielded container 5, and then extends from the container plug 18 to the eluent inlet 16. The tubing 15, extending from the hollow needle 13, passes through a channel in the shielded container 5 to the eluate outlet 17. The inner shielded container 5 is smaller than the outer container 2 and so there is a free space 20 within the outer container 2 above the shielded container 5. This free space 20 accommodates part of the tubing 14, 15 extending from the hollow needles to the eluent inlet and eluate outlet as the lengths of the tubing 14, 15 are both much greater than the minimum length required to connect the hollow needles 12, 13 with the respective eluent inlet 16 and eluate outlet 17.

The top plate 5 of the radioisotope generator 1 has a pair of apertures 21 through which respective eluent inlet and outlet components project. The eluent inlet and eluate outlet components are each hollow spikes 22 though in the case of the inlet component the hollow spike has two holes, one for the passage of fluid and one that is connected to a filtered air inlet. This is more clearly illustrated in FIG. 2 and shall be described in greater detail below. The hollow spike 22 consists of an elongate, generally cylindrical, spike body 23 and an annular retaining plate 24 which is attached to or is moulded as a single part with one end of the spike body 23. The opposing end of the spike body 23 is shaped to a point and has an aperture communicating with the interior of the spike body adjacent the point. This pointed end of the spike body 23 is shaped so that it is capable of piercing a sealing membrane of the type commonly found with sample vials. The annular retaining plate 24 forms a skirt projecting outwardly from the spike body 23 and may be continuous around the spike body or discontinuous in the form of a plurality of discrete projections.

The top cover 4 of the radioisotope generator 1 also includes a pair of apertures 25 arranged so as to align with the apertures 21 in the top plate 3 and shaped to allow through passage of the spike body 23. Thus, each of the hollow spikes 22 is arranged to be held and supported by its annular retaining plate 24 by component supports 26 provided on the inside of the top plate 3 whilst the hollow spike body 23 projects through the apertures in both the top plate 3 and the top cover 4 to the exterior of the outer container 2. Each one of the apertures 25 in the top cover 4 is located at the bottom of a well 27 that is shaped to receive and support either an isotope collection vial or a saline supply vial. Thus, both vials are housed outside of the outer container 2 and are not exposed to radiation from the ion exchange column 7.

In order to supply the ion exchange column with the chloride ions required for elution of the radioisotope, saline solution is drawn through the ion exchange column 7, by establishing a pressure differential across the ion exchange column. This is accomplished by connecting a saline supply vial to the eluent inlet 16 which is in fluid communication with the top end 10 of the ion exchange column 7 via the tubing 14 and hollow needle 12 and connecting an evacuated collection vial to the eluate outlet 17 which is in fluid communication with the bottom end 11 of the ion exchange column 7 via the tubing 15 and hollow needle 13. The pressure differential is established by virtue of the fluid pressure of the saline in the supply vial and the extremely low pressure in the evacuated collection vial. This urges passage of the saline solution through the ion exchange column 7 to the collection vial carrying with it the daughter radioisotope.

Figure 2:
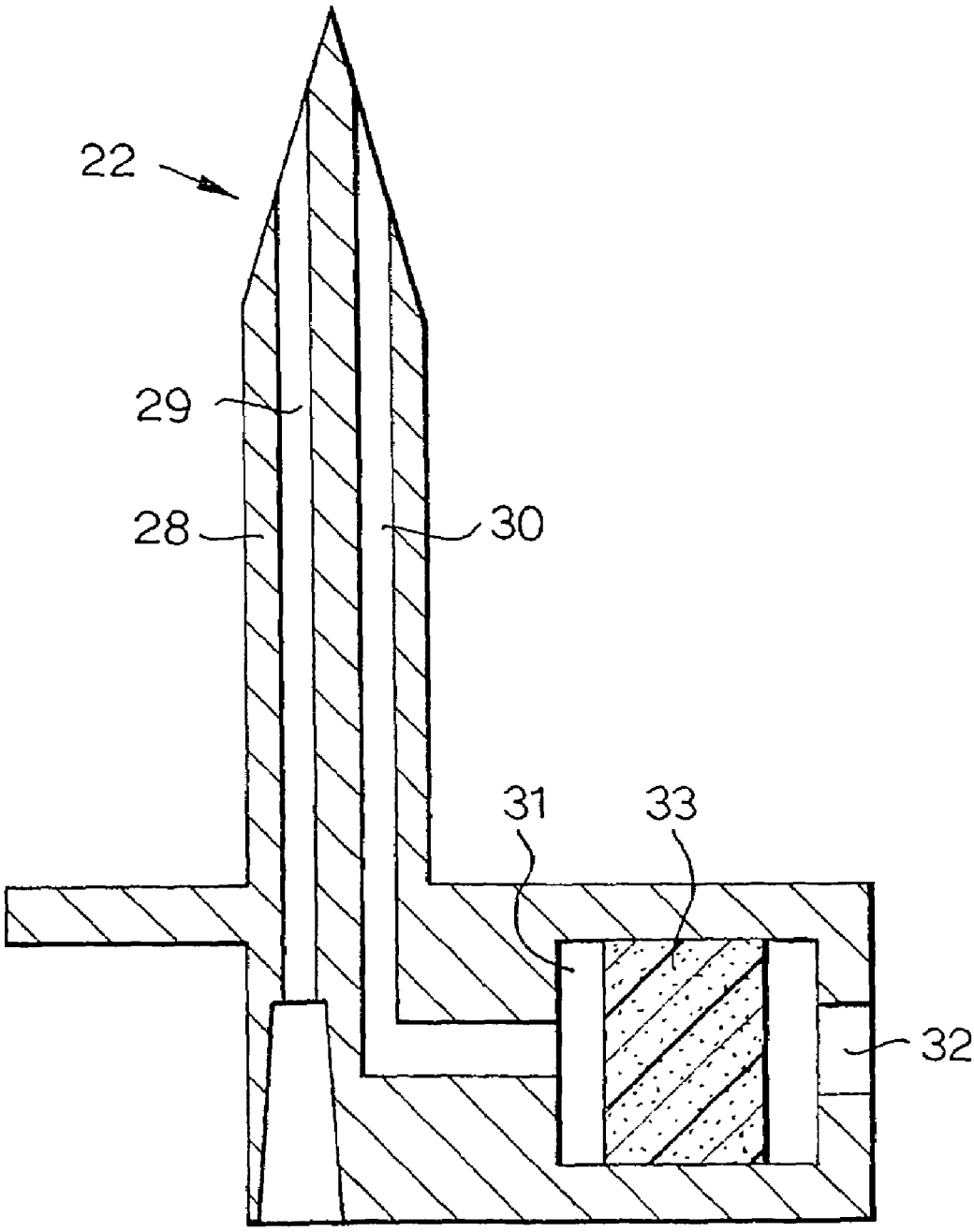
FIG. 2 is an enlarged cross-section of the fluid inlet of the isotope generator of FIG. 1.

As shown in FIG. 2 the hollow spike 22 of the eluent inlet 16 is a single body 28 which is substantially circular in cross-section and has two bores 29, 30 leading to opposed apertures in the sharpened point of the spike. The first of the bores 29 is a eluate bore and communicates directly with the outlet fluid connection of the spike which is, in turn, connected to the tubing 14. The second of the two bores 30 is an air bore and leads to a filter chamber 31 and an air hole 32. Although the two apertures in the spike, as illustrated, are both adjacent the tip of the spike, this is not necessary in all cases. The aperture for the air bore may be located lower down the body of the spike. The filter chamber 31 preferably contains a filter disk 33 of a material suitable for extracting bacteria from indrawn air such as PTFE (polytetrafluoroethylene) and PVDF (polyvinylidenefluoride).

This construction of fluid inlet ensures that the saline solution can be withdrawn from the vial without air, which is necessary to equalize the pressure within the vial, entering the fluid flow. More importantly, as a single spike of substantially circular cross-section is employed to penetrate the seal of the saline vial, rotational movement of the vial within the well 27 does not result in tearing or other damage to the seal which might permit the ingress of unfiltered air and a breach of the aseptic conditions under which the radioisotope is harvested.

Thus, the embodiment of the radioisotope generator described above, provides a more reliable and effective device for the collection of radioisotopes under aseptic conditions. Further and alternative features of the radioisotope generator and of the process of construction of the generator are envisaged without departing from the scope of the present invention as claimed in the appended claims.

What is claimed is:

1. A device for producing a fluid containing a radioactive constituent, the device comprising: a shielded chamber within which is located an isotope container housing a radioactive isotope, the shielded chamber including first and second fluid connections to opposing ends of the isotope container and a fluid conduit extending from each of the first and second fluid connections to a fluid inlet and a fluid outlet respectively characterised in that the fluid inlet comprises a single spike comprising a spike body having a substantially circular cross-section, the spike body being adapted to penetrate the rubber seal of a vial and wherein the spike body further defines a first bore extending from a first aperture adjacent the tip of the spike to a fluid connection with the fluid conduit and a second bore extending from a second, separate aperture in the spike body to a filtering air inlet, wherein the spike body incorporates a barrier filter in the second bore.

2. A device as claimed in claim 1 further comprising an outer housing which supports the fluid inlet and the fluid outlet and the spike of the fluid inlet projects through an aperture in the outer housing.

3. A device as claimed in claim 2, wherein the outer housing defines a well about the aperture through which the spike projects, the well being structured to receive a vial.

4. A device as claimed in claim 1, wherein the barrier filter comprises a filter disk of polytetrafluoroethylene.

5. A device as claimed in claim 1, wherein the filter is positioned in the second bore adjacent to the filtering air inlet.

* * * * *